United States Patent [19]

Johnson et al.

[11] 4,446,634

[45] May 8, 1984

[54] FOOTWEAR HAVING IMPROVED SHOCK ABSORPTION

[76] Inventors: Paul H. Johnson, 2526 W. Newton, Tulsa, Okla. 74127; Robert B. Stevenson, 6713 E. 66th St., Tulsa, Okla. 74133

[21] Appl. No.: 425,437

[22] Filed: Sep. 28, 1982

[51] Int. Cl.[3] ..... A43B 13/18; A43B 13/20; A43B 13/40

[52] U.S. Cl. ..... 36/29; 36/28; 36/43

[58] Field of Search ..... 36/28, 29, 43

[56] References Cited

U.S. PATENT DOCUMENTS

| | | | |
|---|---|---|---|
| 1,148,376 | 7/1915 | Gay | 36/29 |
| 3,225,463 | 12/1965 | Burnham | 36/29 |
| 3,795,994 | 3/1974 | Ava | 36/29 |
| 4,009,528 | 3/1977 | Villari, Jr. et al. | 36/29 |
| 4,129,951 | 12/1978 | Petrosky | 36/29 |
| 4,358,902 | 4/1980 | Cole et al. | 36/28 |

FOREIGN PATENT DOCUMENTS

| | | | |
|---|---|---|---|
| 43172 | 3/1908 | Switzerland | 36/29 |

*Primary Examiner*—Werner H. Schroeder
*Assistant Examiner*—Steven N. Meyers
*Attorney, Agent, or Firm*—Head, Johnson & Stevenson

[57] ABSTRACT

Footwear having improved shock absorption in a shoe having a heel and box portion, a first flat elastomeric bladder supported by the shoe heel portion to bear the weight of the heel of the foot of a user, an elastomeric bladder portion supported by the shoe box portion to bear the weight of the ball portion of the foot of a user, a conduit connecting the first and second bladders, and a valve in the conduit permitting a selectable rate of flow of fluid between the bladders.

3 Claims, 6 Drawing Figures

FOOTWEAR HAVING IMPROVED SHOCK ABSORPTION

SUMMARY OF THE INVENTION

This invention is directed towards a means of reducing the shock imparted to the foot during running and walking. In walking and in most running, except sprinters, the heel strikes the ground followed by a gradual shifting of the weight from the heel to the ball portion of the foot. The heel strike causes substantial shock to the foot. To solve this problem, shoe manufacturers have improved the design and construction of shoes, and particularly running shoes, so that a great amount of the shock is absorbed by the resiliency of the material of which the shoe is made. Others have devised shock absorbing elastomeric inserts for shoes. While such progress has been made in improving shoes, nevertheless, some users still experience difficulty, including the development of soreness in the feet from the effect of shock during walking and running.

The present invention provides a means of significantly reducing the shock by absorbing it in the same nature as a shock absorber used on automobiles; that is, in which shock is absorbed by the movement of fluid. The basic concept is the provision of a flat bladder in a shoe arranged to support the heel portion of the foot of the user and a second flat elastomeric bladder supported by the shoe to support the weight of the ball portion of the foot of the user. A conduit extends between the bladders so that when the heel strikes the ground the weight of the heel portion of the foot of the user forces fluid to flow from the first bladder, through the conduit, to the second bladder under the ball portion. As the foot rolls forward and weight is transferred from the heel to the ball portion, the fluid in the bladder under the ball portion of the foot receives and supports the weight of the user and absorbs shock by transferring fluid from that portion back into the bladder under the heel portion.

The basic concept of shock absorption by transfer of fluid from the heel to the ball portion of a user's foot has been known as illustrated in previously issued U.S. Pat. Nos. 1,605,985; 3,469,576; 3,765,422; 3,724,106; 3,871,117; 3,180,039; 1,539,199; and 4,100,686. These references are not exhaustive but are illustrative of the state of the art which suggests that the transfer of fluid can be employed to achieve shock absorption in a shoe. The prior art, however, has not recognized nor solved the problem to successfully apply the principle of the transfer of fluid for shock absorption in shoes, and particularly running shoes. In order for shock absorption to be successful, the rate of fluid transfer from one bladder to the other is critical. If the fluid transfers too rapidly, the shock absorption is substantially eliminated. On the other hand, if the fluid is not transferred rapidly enough the desired shock absorption is not achieved.

The present invention solves the problem existing in the state of the art by providing a valve for controlling the rate of fluid transfer so that maximum shock absorption can be achieved and can be adjusted according to the weight of the user and the speed of walking or running.

Another problem which exists with running shoes is that of over-pronation. Many runners tend to over-pronate, causing an excessive amount of shifting of weight from the outside towards the inside of the foot during each stride. This tends to cause shoes to deform and, in addition, such over-pronation is a source of injury, particularly to the knee. The present invention provides a means of compensating for over-pronation by separately applying support force for the left and right sections of a shoe so that more support can be provided for the inside portion. This is accomplished in a manner in which the amount of support is adjustable, allowing the user to individually adjust shoes to achieve maximum shock absorption and pronation correction.

DETAILED DESCRIPTION

Figure 1:
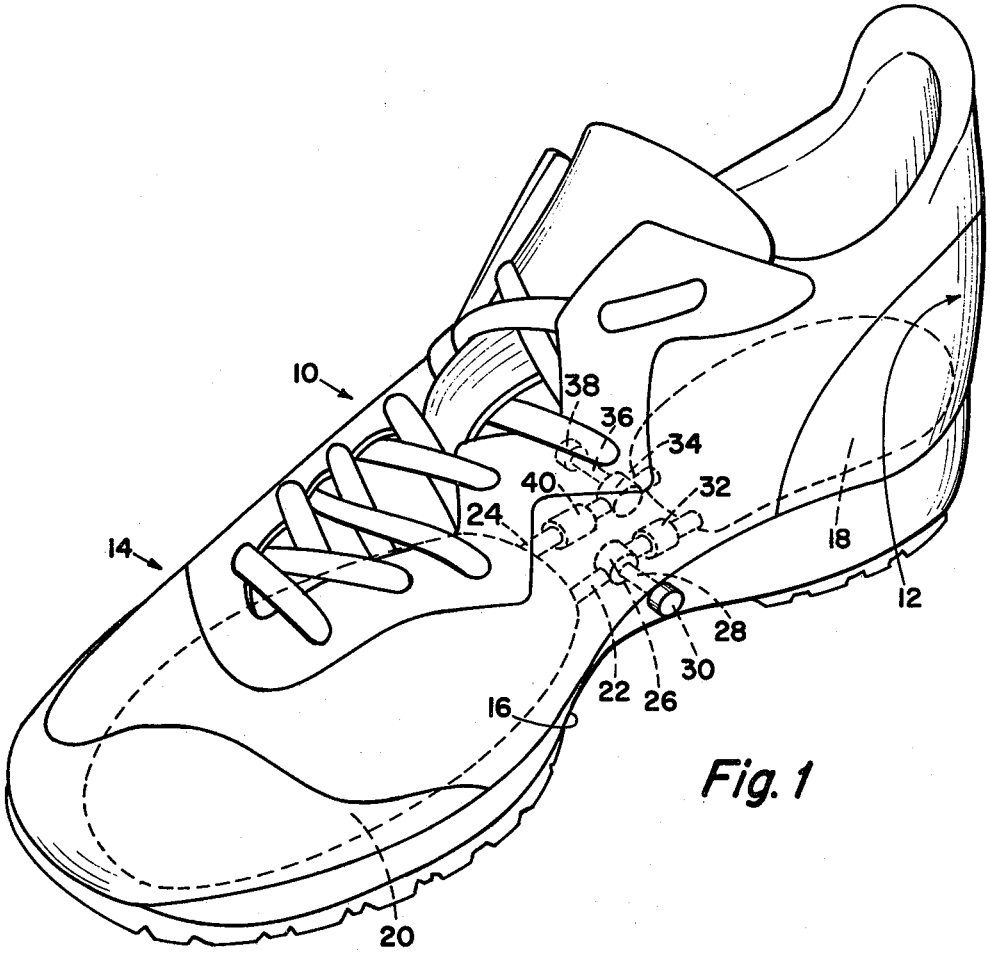
FIG. 1 is an isometric external view of a typical running shoe with the portions added by this invention shown in dotted outline.

Referring to the drawings and first to FIG. 1, an embodiment of the invention is illustrated in connection with a running shoe generally indicated by the numeral 10. The shoe has a heel portion generally indicated by the numeral 12, a box portion generally indicated by the numeral 14 which receives the forward part of the foot of the user, and a sole 16.

Formed as an integral part of the shoe 10 is a first, flat elastomeric bladder 18 which is supported by the shoe heel portion 12 in such a way as to to bear at least part of the weight of the heel portion of the foot of a user. A second bladder 20 is supported by the box portion 14 of the shoe 10 to bear at least part of the weight of the ball portion of the foot of a user. Conduit means connect the first bladder 18 to second bladder 20. In the illustrated arrangement of FIG. 1 the conduit means consists of a first conduit 22 and a second conduit 24. Positioned in first conduit 20 is a first valve 26 having a valve adjustment shaft 28 terminating at the outer end in a knob 30. In addition, in conduit 22 is a check valve 32 which permits fluid to flow only from bladder 18 to bladder 20 and prohibits fluid from flowing in the opposite direction.

In conduit 24 are a duplication of the same elements, that is, a valve 34 having a shaft 36 terminating in a knob 38. A check valve 40 permits fluid to flow only from second bladder 20 to first bladder 18 and prohibits fluid from flowing in the opposite direction.

Figure 2:
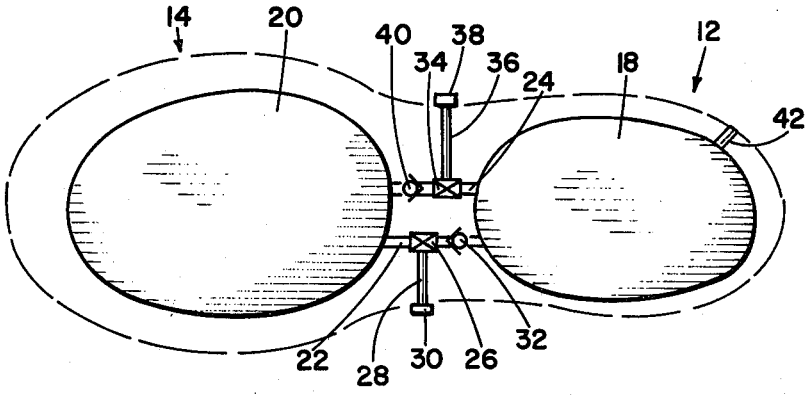
FIG. 2 is a schematic plan view of the bladders, conduits, and valves as employed in practicing an embodiment of this invention.

The bladders 18 and 20 have a fluid therein which may be in the form of a gas, such as air, or a liquid, such as light oil. As shown in FIG. 2, a small conduit 42 communicates between the first bladder 18 with the exterior of the shoe providing means for filling the bladders 18 and 20. This conduit 42 may be in the form of a elastomeric member which is normally flat and leakproof but which can be opened by the insertion of a needle in the technique frequently employed for filling footballs, basketballs, and the like.

Figure 4:
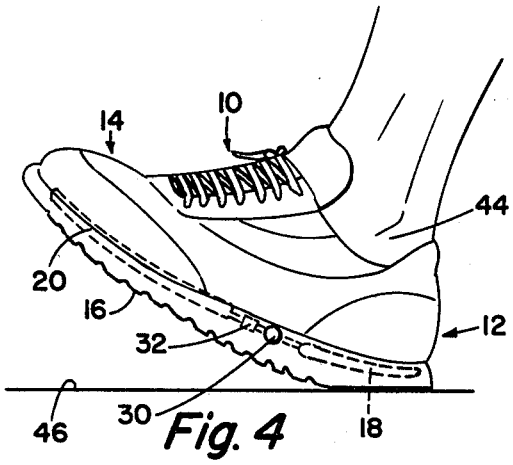
FIG. 4 is an elevational view of a shoe as worn by a user showing the apparatus employed in this invention in dotted outline and showing the heel of the user striking a support surface.
Figure 5:
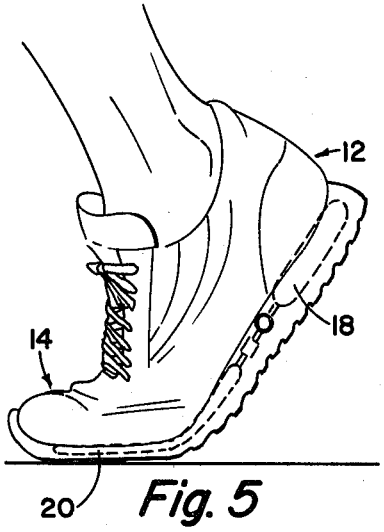
FIG. 5 is a view as in FIG. 4 but showing the user in the position as weight has been shifted to the ball portion of the foot.

Referring to FIGS. 4 and 5 now in conjunction with FIGS. 1, 2, and 3, the operation of the shock absorber system will be described. FIG. 4 illustrates a shoe 10 on a user's foot 44 and shows the attitude of the shoe 10 in the portion of the stride wherein the heel portion 12 is in engagement with the support surface 46 such as the ground, sidewalk, pavement, track, or the like. When the heel strikes, the force of the heel of the user is applied at least in part to first bladder 18. This will force fluid to flow in the direction indicated by the arrow through valve 26 which is behind the knob 30 and through check valve 32 into the second bladder 20. The rate at which fluid flows from bladder 18 can be accurately adjusted by regulating valve 26 by the rotation of knob 30. If a runner runs at a fast rate, the length of the time the heel portion 12 is in contact with the support surface 46 is relatively short, whereas if the shoe is being worn by a person walking at a relatively slow rate, the time would be substantially longer. In order for effective shock absorption, the fluid must flow from bladder 18 as the weight is transferred to it, thus the fluid flowing from the bladder allows the weight applied by the heel of the user to gradually settle downwardly relatively to the other portions of the shoe and the support surface. This slight vertical displacement thereby absorbs significant amounts of shock by spreading the time of transfer of the force of the heel of the user over a longer time rather than instantaneously as occurs when no shock absorption exists. Valve 26 can also be used to control the rate of fluid flow to compensate for the weight of the user.

As the foot of the user rolls forward the user's weight is transferred from the heel portion 12 to the box portion 14 of the shoe, that is, the weight of the user is transferred to the ball portion of the foot, applying pressure on the second bladder 20. As this pressure is applied, fluid is forced from second bladder 20 through conduit 40 (see FIG. 2) to the first or heel bladder 18. Fluid can flow from the second or ball bladder 20 to the first or heel bladder 18 only through conduit 24 and not through conduit 22 because of the orientation of the check valves 32 and 40. This means that valve 34 may be used to independently control the rate of fluid transfer and thereby the rate of shock absorption of the second bladder 20.

Normally, the heel strike produces a more sudden shock to the heel than does the transfer of the weight to the ball portion of the foot. Therefore, for the normal user, it will be important that valve 26 be adjusted so as to provide a more rapid transfer of fluid from first bladder 18 to bladder 20 than will be required to allow fluid to flow from second bladder 20 to first bladder 18. That is, a faster fluid flow rate will normally be employed through valve 26 compared to valve 34. By the provision of the separate valving systems, maximum shock absorption for all portions of the stride of the user can be achieved and independently adjusted by the user for his walking or running style.

Figure 6:
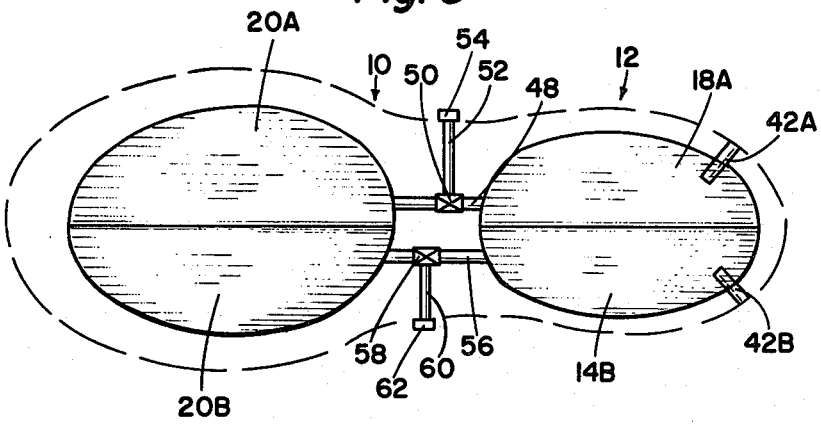
FIG. 6 is a plan view of the elements employed in the invention as in FIG. 2 but showing an alternate embodiment wherein the invention is particularly applicable to correct over-pronation by a user.

FIG. 6 is a diagrammatic plan view as in FIG. 2 showing an alternate embodiment of the invention in which the first bladder 18 is formed of a right-hand portion 18A and a left portion 18B. In like manner, the second bladder is formed of a right portion 20A and a left portion 20B. A conduit 48 connects the first bladder right portion 18A with the second bladder right portion 20A. A valve 50 is provided in conduit 48 controlled by a shaft 52 and knob 54. In like manner, a conduit 56 connects the first bladder left portion 18B with the second bladder left portion 20B. Conduit 56 includes a valve 58 having shaft 60 and knobs 62. The function of the embodiment of FIG. 6 is to control pronation. As previously stated, the problem experienced by many runners is over-pronation, that is, the inward shifting of the foot as weight is transferred between the heel and the ball portion of the foot. Assume that the shoe 10 of FIG. 6 goes on the right foot of the user. As the heel portion 12 strikes, fluid is caused to flow from both first bladder portions 18A and 18B into both second bladder portions 20A and 20B. However, the rate of fluid flow is independently adjustable so that if the user tends to over-pronate, the rate of fluid flow controlled by valve 18 may be adjusted to be slower than that through valve 50. This means that as the foot of the user rolls forward the left or inward side of the foot is supported longer and at a greater elevation. In addition, by the separate filling means 42A and 42B the amount of fluid in the left-hand portions 18B and 20B of the bladder can be increased relative to the amount of fluid in the right-hand portions 18A and 20A, thus, in addition, providing a variable wedge effect in the shoe of the user.

While FIG. 6 shows only a single conduit 56 connecting the left bladder portion 18B and 20B and a single conduit 48 connecting the right bladder portions 18A and 20A, it can be seen that if the rate of fluid transfer is to be independently adjustable that two conduits may be employed with check valves as illustrated in FIGS. 1 and 2, in which case there would be four conduits and four valves with four check valves.

The invention provides a unique means of accurately controlling shock absorption which is individually adjustable and variable by the user so that he can "fine tune" shoes to his individual needs.

Figure 3:
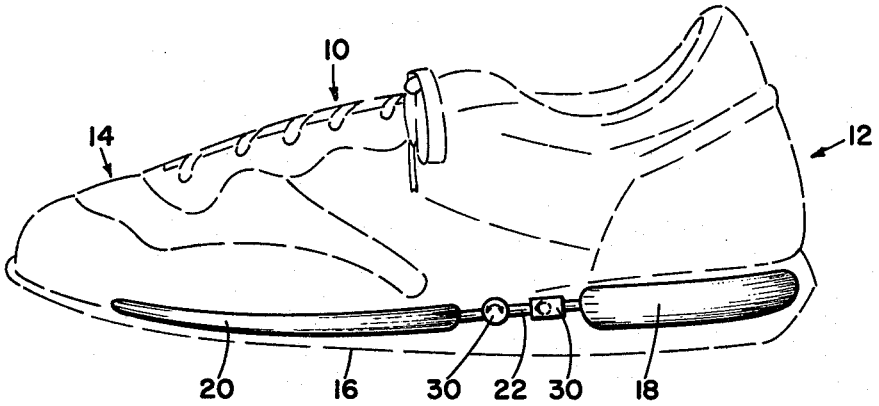
FIG. 3 is an elevational side view of a running shoe shown in dotted outline with the shock absorption means of this invention shown in solid line.

The bladders 18 and 20 may be integrally formed with the shoe 10 such as by encompassing them within the structure of the sole portion of the shoe as illustrated in FIG. 3. In another embodiment the elements making up the invention may be in the form of an insert positionable within a shoe as illustrated in FIG. 1, or in the form of an insert having a covering above the elements or a covering both above and below the elements. The method of applying the concepts of the invention to shoes will depend upon the particular manufacturer and upon the type of other shock absorption means employed in conjunction with those of this invention.

While knobs 30, 38, 54 and 52 are illustrated, they are by way of example to indicate that valves 26, 34, 50 and 58 are manually adjustable. Other adjusting means may be employed. For instance, shafts 28, 36,52 and 60 may have screwdriver slots in the end.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. Footware having improved shock absorption means comprising:

a shoe having a heel, a box portion and a sole;

a first flat elastomeric bladder supported by said shoe heel portion to bear, at least in part, the weight of the heel portion of the foot of a user;

a second flat elastomeric bladder supported by said shoe box portion to bear, at least in part, the weight of the ball portion of the foot of a user;

a first and second conduit channel connecting said first and second bladders;

means of introducing fluid into said bladders;

a separate valve means in each of said channels; and a check valve in one channel preventing fluid flow from said first to said second bladder and a check valve in the other channel preventing fluid flow from said second to said first bladder, thereby providing means to independently control the rate of fluid flow in both directions between said bladders.

2. Footware having improved shock absorption means comprising:

a shoe having a heel, a box portion and a sole;

a first flat elastomeric bladder formed of a left and right portion supported by said shoe heel portion to bear, at least in part, the weight of the heel portion of the foot of a user;

a second flat elastomeric bladder formed of a left and right portion supported by said shoe box portion to bear, at least in part, the weight of the ball portion of the foot of a user;

a first conduit connecting said first bladder right portion to said second bladder right portion;

a second conduit connecting said first bladder left portion to said second bladder left portion;

means of introducing fluid into said left and right bladders;

a first valve means in said first conduit; and a second valve means in said second conduit, wherein the rate of fluid flow between said left and right bladders may be independently adjusted.

3. Footwear according to claim 1 or 2 wherein said bladders, conduit means, valve means and means of introducing fluid into said bladders are embodied in an insert positionable within said shoe.

* * * * *